US005474140A

United States Patent [19]

Stevens

[11] Patent Number: 5,474,140

[45] Date of Patent: Dec. 12, 1995

[54] SOIL SAMPLING PROBE

[76] Inventor: Jim A. Stevens, 1725 Trinity Rd., Troutville, Va. 24175

[21] Appl. No.: 332,138

[22] Filed: Oct. 31, 1994

[51] Int. Cl.[6] ..... E21B 49/02

[52] U.S. Cl. ..... 175/20; 175/59; 175/248; 175/249

[58] Field of Search ..... 175/20, 58, 59, 175/245, 248, 249, 405

[56] References Cited

U.S. PATENT DOCUMENTS

| | | | |
|---|---|---|---|
| 3,042,124 | 7/1962 | Andersson | 175/20 |
| 3,306,110 | 2/1967 | Woods | 175/20 X |
| 3,786,877 | 1/1974 | Schafer et al. | 175/249 |
| 3,817,338 | 6/1974 | Guest | 175/239 |
| 3,871,487 | 3/1975 | Cooper et al. | 175/248 |
| 3,878,906 | 4/1975 | Guest | 175/20 X |
| 3,986,555 | 10/1976 | Robertson | 175/249 X |
| 4,258,803 | 3/1981 | Thompson et al. | 175/233 |
| 4,566,545 | 1/1986 | Story et al. | 175/249 X |
| 4,729,437 | 3/1988 | Zapico | 175/20 |
| 4,809,790 | 3/1989 | Manchak | 175/58 X |
| 4,848,484 | 7/1989 | Clements | 175/20 |
| 4,953,637 | 9/1990 | Starr et al. | 175/20 |
| 5,186,263 | 2/1993 | Kejr et al. | 175/20 |
| 5,211,249 | 5/1993 | Richter et al. | 175/20 |
| 5,411,087 | 5/1995 | Taylor | 175/20 |
| 5,421,419 | 6/1995 | Heller et al. | 175/20 |

*Primary Examiner*—Roger J. Schoeppel
*Attorney, Agent, or Firm*—Richard C. Litman

[57] ABSTRACT

The present invention is a soil sampling probe where a conical piston is kept at the opening to the sampling container by a first threaded portion near the top of the piston rod which engages a threaded opening near the top end of the container. With the piston in this position the probe is more streamlined to reduce the required driving force. When the desired depth is reached, the piston rod is rotated until the first threaded portion of the piston rod is disengaged from the threaded opening at the top end of the container. The piston is then raised until a second threaded portion of the piston rod, near the piston itself, engages a threaded lock ring near the top end of the container. Thus the piston is locked in place near the top of the container. The container is then further inserted to take the core sample.

13 Claims, 2 Drawing Sheets

40
38
38
56
56
20
10
12

40
38
56
38
56
20
10
12

40
56
38
56
38
10
20
12

SOIL SAMPLING PROBE

BACKGROUND OF THE INVENTION

1. Field of the Invention

The present invention relates to a soil sampling probe for removing core samples from a desired depth below the surface of the earth.

2. Description of the Prior Art

It is common practice to obtain subterranean soil samples, also known as core samples, for a variety of purposes such as determining soil conditions prior to the construction of structures, determining the drainage characteristics of the soil, location of underground mineral deposits, studies of chemical dissipation and residue, determination of concentration of environmental contaminants, and investigation of hazardous waste sites. To be useful, the soil sample must be undisturbed and also the sampling device must sample soil only at the depth desired by the operator of the device.

Many soil sampling devices have been proposed in the prior art.

U.S. Pat. No. 3,042,124, issued to Andersson, shows a soil sampling probe having a conical piston within a sampling spoon. When the piston is in the lower most position, the sampling spoon abuts a flange on the piston rod to keep the spoon assembly from sliding up the piston rod during insertion into the ground. When the probe is at the desired depth the piston is drawn up while frictional forces between the spoon assembly and the earth keep the spoon assembly in place. With the piston in the upper most position within the spoon, the piston rod is rotated to bring lugs on the piston rod into locking engagement with recesses in the upper part of the spoon assembly. Further insertion of the probe then fills the spoon with soil.

U.S. Pat. No. 3,817,338, issued to Guest, shows a split barrel soil sampling spoon. Guest does not disclose how soil is prevented from entering the spoon before it reaches the desired depth.

U.S. Pat. No. 4,729,437, issued to Zapico, shows a soil sampling probe designed to be inserted into a preexisting well. The probe comprises a sampling spoon with a plug attached at the cutting end. When the probe reaches the bottom of the well, the plug is removed by pulling on a chord and the spoon is pushed into the soil to take a sample.

U.S. Pat. No. 4,848,484, issued to Clements, shows a soil sampling container with a hinged side cover. Clements does not disclose a closure for the cutting end of the sampling container.

U.S. Pat. No. 4,953,637, issued to Starr et al., shows a soil sampling probe wherein a series of tubular sleeves connected end to end are pushed into the ground. A conical piston acts to close the cutting end and is kept in place, during insertion into the ground, by a series of extension rods running along the entire length of the assembly of sleeves.

U.S. Pat. No. 5,186,263, issued to Kejr et al., shows a soil sampling probe where a conical piston is kept at the opening to the sampling spoon by a threaded plug at the top end of the spoon. When the desired depth is reached, the plug is removed and the piston is thus allowed to slide up within the spoon as the spoon is further inserted to take the core sample.

None of the above inventions and patents, taken either singly or in combination, is seen to describe the instant invention as claimed.

SUMMARY OF THE INVENTION

The present invention is a soil sampling probe where a conical piston is kept at the opening to the sampling spoon by a first threaded portion near the top of the piston rod which engages a threaded opening near the top end of the spoon. When the desired depth is reached, the piston rod is rotated until the first threaded portion of the piston rod is disengaged from the threaded opening at the top end of the spoon. The piston is then raised until a second threaded portion of the piston rod, near the piston itself, engages a threaded lock ring near the top end of the spoon. Thus the piston is locked in place near the top of the spoon. The spoon is then further inserted to take the core sample.

Accordingly, it is a principal object of the invention to provide a soil sampling probe that causes minimal disturbance to the soil sample.

It is another object of the invention to provide a soil sampling probe that can sample subterranean soil at any desired depth.

It is a further object of the invention to provide a soil sampling probe which fits standard auger rig tools and probe driving mechanisms.

Still another object of the invention is to provide a soil sampling probe which does not require application of driving forces to piston rod extensions during the driving of the probe to the desired depth.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
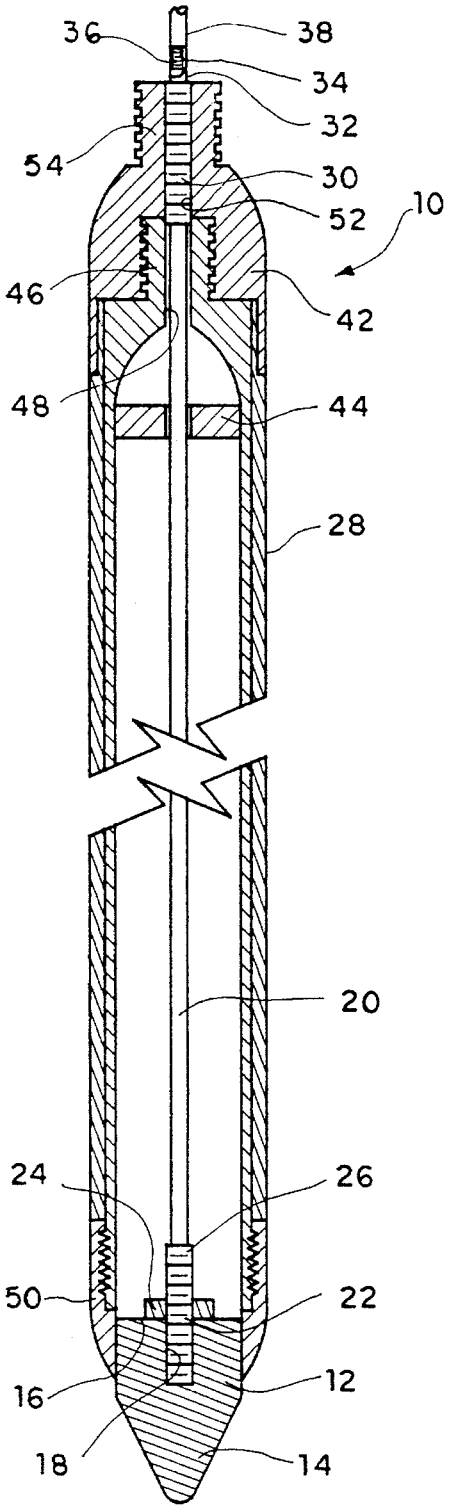
FIG. 1 is a partial cross sectional view of the soil sampling probe of the present invention with the piston in the lowermost or driving position.
Figure 2:
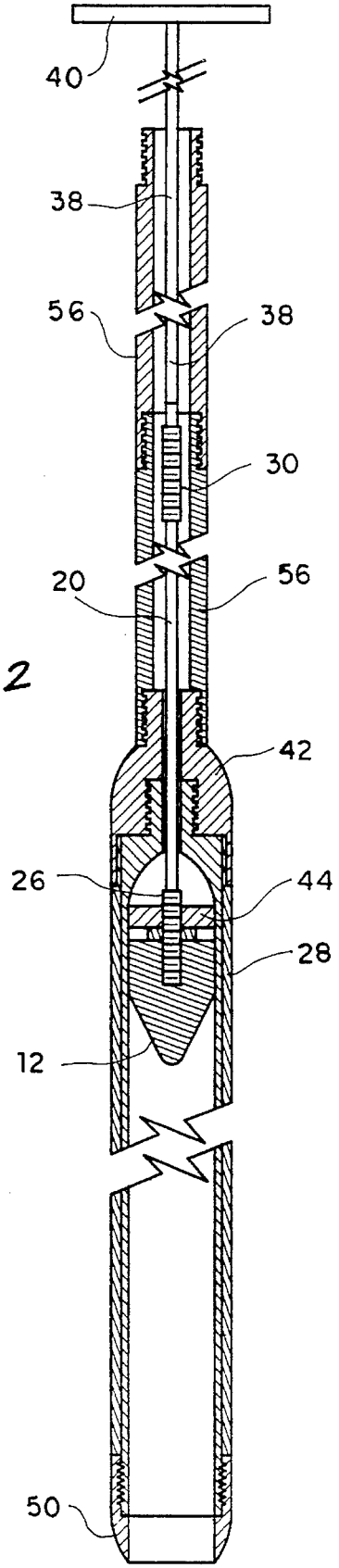
FIG. 2 is a partial cross sectional view of the soil sampling probe of the present invention with the piston in the uppermost or sampling position.
Figures 3A, 3B, 3C:
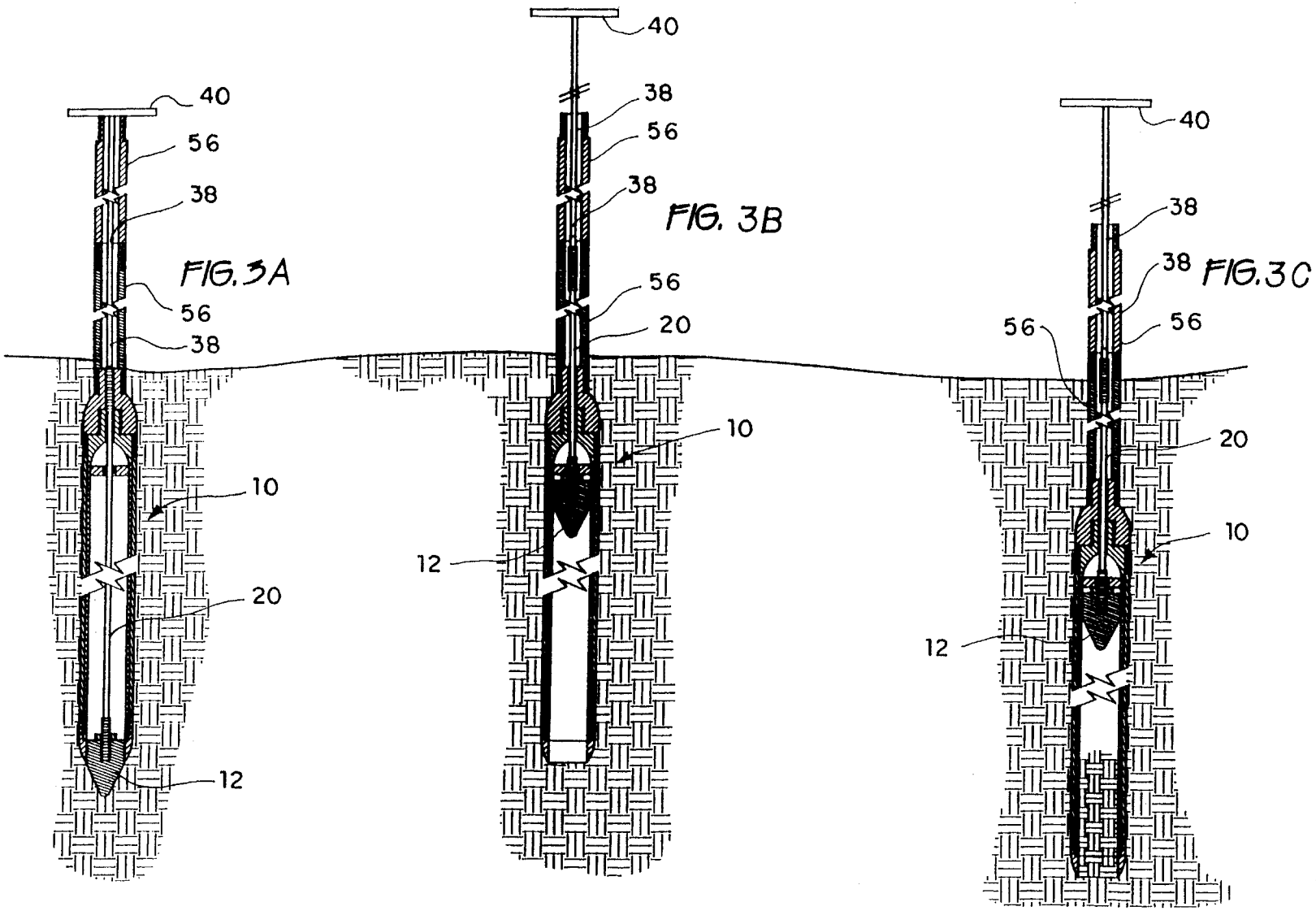
FIGS. 3*a*–3*c* are partial cross sectional views of the soil sampling probe of the present invention in operation.

Referring to FIGS. 1 and 2, the present invention is a soil sampling probe 10 including a piston 12, a piston rod assembly, and a split barrel sample container assembly.

The piston 12 is in the shape of a right circular cylinder having a cone shaped penetrating tip 14 and a substantially flat rear end 16. The cone shaped penetrating tip 14 serves to ease the penetration of the probe into the ground. A threaded hole 18 is provided at the flat end for receiving the piston rod 20.

The piston rod 20 has a first end which is provided with a threaded portion 22. The threaded portion 22 matingly engages the threads inside the hole 18, and a nut 24 serves to secure piston 12 to piston rod 20. After the piston 12 is secured to piston rod 20 a portion of the threaded portion 22 will remain exposed. This exposed threaded portion 26 will serve to fix the piston 12 at the top of the split barrel sampling container 28 as will be discussed below.

The piston rod 20 has a second threaded portion 30 near its second end 32. The threaded portions of the piston rod 20 have root diameters that are larger than the diameter of the unthreaded portions of the piston rod 20. Also at the second end 32 is a coupling in the form of a threaded hole 34. The hole 34 is designed to receive a threaded reduced diameter portion 36 of the piston rod extension 38. The piston rod extension 38 has a threaded hole similar to hole 34 at the end distal from the reduced diameter portion 36. A plurality of piston rod extensions 38 can be connected in end-to-end relationship, thus allowing an operator on the surface to manipulate the piston 12 using the T-shaped handle 40. The T-shaped handle 40, the piston rod extensions 38, and the piston rod together form the piston rod assembly referred to above.

The split barrel sample container assembly includes an adapter 42, a split barrel sampling container 28, also known in the art as a split spoon sampler, and a lock ring 44. The split barrel sampling container 28 is generally in the form of a hollow elongated cylinder having a threaded nipple 46. An opening 48, concentric with the bore of the split barrel sample container, is provided in the nipple 46 to allow the piston rod 20 to pass out of the bore of the split barrel sampling container 28. The opening 48 is large enough to allow the piston rod 20, including the threaded portion 30, to slide freely therethrough.

The split barrel sample container 28, as the name implies, is split into two halves along a plane containing the longitudinal axis of the split barrel sample container. The two halves are held together by the adapter 42 and the shoe 50. To remove a soil sample from the split barrel sample container 28, the split barrel sample container is first disengaged from the adapter 42, and then the shoe 50 is disengaged from the split barrel sample container. The two halves then come apart allowing access to the soil sample.

In the embodiment illustrated in the Figures the shoe 50 engages mating threads provided at the bottom of the split barrel sample container 28. Alternatively the shoe may be made integrally with one of the halves of the split barrel sample container 28. In such a case half the annular cross section of the shoe is contiguous with one of the halves of the split barrel sample container 28. The other half of the annular cross section of the shoe is exposed and has a recess. When the two halves of the split barrel sample container are brought together, the half without the shoe can slide down with respect to the half with the shoe, until a reduced diameter extension at the bottom rim of the half without the shoe engages the recess in the exposed part of the cross section of the shoe. Then when the nipple 46 is screwed into the adapter 42, the two halves are fixedly held together.

The shoe 50 is preferably made of a hardened steel, and is shaped to provide a cutting edge at the circumference of the bottom opening of the split barrel sample container 28. This cutting edge allows the split barrel sample container 28 to be more easily driven into the ground during the soil sampling step which will be discussed below.

The lock ring 44 is fixed, preferably welded, to one of the halves of the split barrel sample container 28 near the top of the bore of the split barrel sample container 28. The lock ring 44 is provided with internal threads that matingly engage the threaded portion 26 of the piston rod 20.

The adapter 42 has an internally threaded portion for receiving the nipple 46. When the nipple 46 is engaged to the adapter 42, the opening 48 registers with the internally threaded opening 52. The opening 52 is dimensioned and configured to matingly engage the threaded portion 30 of the piston rod 20. The adapter 42 also has an externally threaded nipple 54 that is matingly engageable with pipe sections 56.

The probe 10 is designed to have a streamlined outside surface in order to more easily penetrate through the soil.

FIGS. *3a–3c* show the probe 10 in use. While the probe is above ground the piston rod 20 is inserted into the split barrel sample container assembly until the threaded portion 30 engages the threaded hole 52. The threaded portion 30 is then screwed into the hole 52 until the piston 12 is positioned within the bottom opening of the split barrel sample container with the penetrating tip 14 protruding through the aforementioned bottom opening. This piston position is also referred to as the driving position hereinafter.

A standard pipe section 56 is attached to the probe 10 and a piston rod extension 38 is attached to the piston rod 20. The probe 10 is then driven into the ground using any commonly known manual or powered driver. The driver may be percussive with several hundred to a few thousand impacts per minute, or may exert a steady force. As the probe is inserted deeper additional pipe sections 56 and piston rod extensions 38 are added to maintain contact with the probe 10.

Once the probe has reached the desired depth the piston rod 20 is turned, using handle 40, to withdraw the threaded portion 30 from the threaded hole 52. It should be noted that the threaded portion 30 and the threaded hole 52 have left handed threads. Thus the handle 40 must be turned clockwise in order to withdraw the threaded portion 30 from the hole 52. In this manner the connections between the piston rod extensions 38, which use right handed threads, will not be loosened as the threaded portion 30 is withdrawn from the threaded hole 52. As the threaded portion 30 of the piston rod 20 is unscrewed from the threaded hole 52, the piston 12 is raised within the bore of the split barrel sample container 28. Once the threaded portion 30 is disengaged from the hole 52, the piston 12 can be drawn up within the bore of split barrel sample container 28 until the threaded portion 26 engages lock ring 44. The threaded portion 26 and the lock ring 44 have right handed threads, therefore the handle 40 must be turned counter clockwise to draw the threaded portion 26 through the lock ring 44. However, the torque required for this operation is not sufficient to loosen the piston rod extensions 38.

Once the threaded portion 26 is drawn into the lock ring 44, the piston 12 becomes fixed near the top of the bore of the split barrel sample container 28 as shown in FIGS. 2 and *3b*. This piston position is referred to as the sampling position. With the piston in the sampling position the probe is further driven into the ground to fill the split barrel sample container 28 with an undisturbed core sample of the soil at the desired depth. The probe is then withdrawn to the surface carrying the soil sample with it.

Various types of steel are preferably used as the construction material throughout the probe 10. However, other materials having the requisite rigidity and strength may also be used.

It is to be understood that the present invention is not limited to the sole embodiment described above, but encompasses any and all embodiments within the scope of the following claims.

I claim:

1. A soil sampling probe comprising:

a split barrel sample container having first and second ends, and a bore, said bore having a longitudinal axis;

a lock ring fitted within said bore proximate said split barrel sample container first end and having an inside surface, and said lock ring having female threads on the inside surface thereof;

a piston arranged to slidably move within said bore; and a piston rod having first and second ends, said piston rod first end engaging said piston, and said piston rod being substantially concentric with said bore.

2. The soil sampling probe according to claim 1, wherein said piston rod includes a first threaded portion adjacent said piston and a second threaded portion adjacent the second end of said piston rod.

3. The soil sampling probe according to claim 2, wherein said piston rod passes through said lock ring.

4. The soil sampling probe according to claim 3, wherein said first threaded portion is dimensioned and configured so as to be matingly engageable with said female threads on the inside surface of said lock ring.

5. The soil sampling probe according to claim 3, wherein said split barrel sample container has an externally threaded portion at the first end of said split barrel sample container, and said split barrel sample container has a hole through the first end thereof to allow said piston rod to pass out of said bore.

6. The soil sampling probe according to claim 5, wherein said split barrel sample container has an opening, coextensive with said bore, at the second end of said split barrel sample container, and further includes a shoe disposed at the second end of said split barrel sample container, said shoe having a circular cutting edge that defines the circumference of the opening at the second end of said split barrel sample container.

7. The soil sampling probe according to claim 6, further including an adapter having a first end, a second end, and a longitudinal axis, the first end of said adapter being externally threaded to receive a standard pipe section used in soil sampling, the second end of said adapter being internally threaded and engaging said externally threaded portion at the first end of said split barrel sample container, said adapter having a through hole concentric with the longitudinal axis of said adapter, the through hole in said adapter being internally threaded and being in registry with the hole through the first end of said split barrel sample container.

8. The soil sampling probe according to claim 7, wherein said second threaded portion adjacent the second end of said piston rod is dimensioned and configured so as to be matingly engaged to the internally threaded through hole in said adapter when said soil sampling probe is being driven to a preselected depth, whereby the piston is positioned to act as a closure for the opening at the second end of said split barrel sample container.

9. The soil sampling probe according to claim 8, wherein said first threaded portion of said piston rod, adjacent said piston, is dimensioned and configured so as to be matingly engaged to the female threads on the inside surface of said lock ring when said soil sampling probe has reached the preselected depth, whereby said piston is maintained in an uppermost position within said bore, thus allowing soil to fill said split barrel sample container as said split barrel sample container is further driven into the ground.

10. The soil sampling probe according to claim 9, wherein said piston has a flat end and a substantially conical end, and said piston rod engages said piston at the flat end of said piston.

11. The soil sampling probe according to claim 9, wherein the second threaded portion adjacent the second end of said piston rod and the through hole in said adapter have left handed male threads and left handed female threads respectively.

12. The soil sampling probe according to claim 9, wherein a coupling is provided at the second end of said piston rod whereby a piston rod extension may be attached to said piston rod.

13. A soil sampling probe comprising:

a split barrel sample container having first and second ends, and a bore, said bore having a longitudinal axis;

a piston arranged to slidably move within said bore; and a piston rod having first and second ends, said piston rod first end engaging said piston, and said piston rod being substantially concentric with said bore, said piston rod including a first threaded portion adjacent said piston and a second threaded portion adjacent the second end of said piston rod, whereby movement of the piston rod along the longitudinal axis of said bore causes corresponding sliding movement of said piston within said bore.

* * * * *